United States Patent [19]

Wolcott, Jr.

[11] 4,246,093

[45] Jan. 20, 1981

[54] HANDLING OF SOLIDS-LADEN HYDROCARBONACEOUS BOTTOMS IN A RETORT USING SOLID HEAT-CARRIERS

[75] Inventor: Herbert B. Wolcott, Jr., Plano, Tex.

[73] Assignee: Atlantic Richfield Company, Los Angeles, Calif.

[21] Appl. No.: 61,155

[22] Filed: Jul. 26, 1979

Related U.S. Application Data

[63] Continuation-in-part of Ser. No. 963,237, Nov. 24, 1978, abandoned.

[51] Int. Cl.[3] ..... C10B 49/16; C10B 53/06

[52] U.S. Cl. ..... 208/8 R; 208/11 R

[58] Field of Search ..... 208/8 R, 11 R

[56] References Cited

U.S. PATENT DOCUMENTS

| | | | |
|---|---|---|---|
| 2,608,526 | 8/1952 | Rex | 208/8 R |
| 2,657,124 | 10/1953 | Gaucher | 208/8 R |
| 3,839,186 | 10/1974 | Berger | 208/8 R |
| 3,844,929 | 10/1974 | Wunderlich et al. | 208/11 R |
| 4,080,285 | 3/1978 | McKinney et al. | 208/11 R |
| 4,101,412 | 7/1978 | Choi | 208/8 R |
| 4,105,502 | 8/1978 | Choi | 208/8 R |

*Primary Examiner*—Herbert Levine
*Attorney, Agent, or Firm*—M. David Folzenlogen

[57] ABSTRACT

Crushed mined coal, oil shale or tar sands, feedstocks are retorted in a retort using heat-carrying solids to supply at least fifty percent of the heat required to produce an average retort temperature of between 700° F. (371° C.) and 1200° F. (649° C.) to produce hydrocarbonaceous gases and oil. The hydrocarbon oils are treated in a manner such that there is produced a bottoms fraction containing organic carbon compounds having a boiling point above 950° F. and particulate inorganic matter derived from the retorted material. The bottoms fraction is fed directly or indirectly into the retort in a manner such that the bottoms fraction does not contact the reheated heat carriers before the heat carrying solids are contacted with the crushed mined feedstock. The bottoms fraction may be fed directly into the retort downstream of the point where the feedstock and heat carriers are first mixed, or the bottoms fraction may be fed into the feedstock before the feedstock enters the retort. This method of handling the bottoms fraction prevents breakage or agglomeration of the heat carrying solids.

4 Claims, 1 Drawing Figure

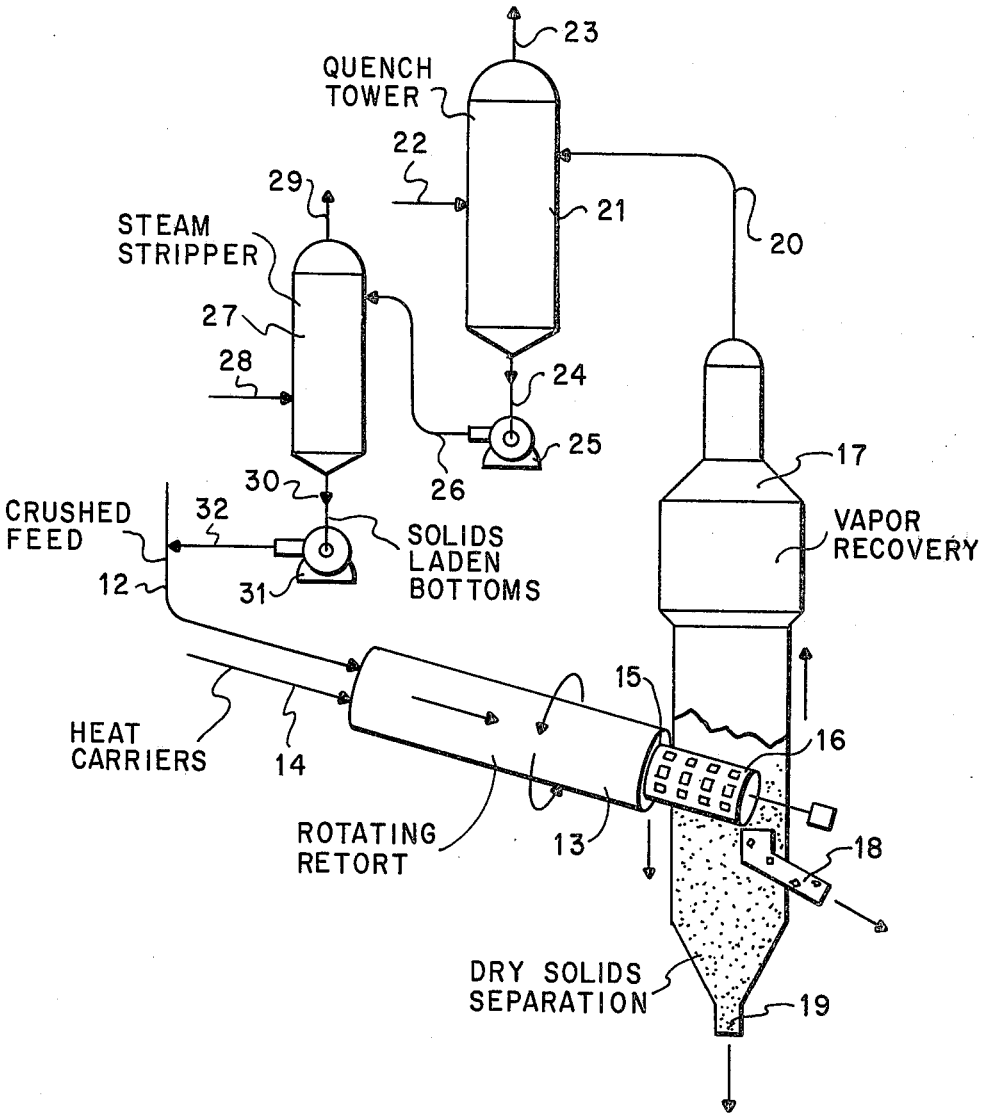
23
QUENCH TOWER
22
21
20
29
STEAM STRIPPER
27
28
24
25
26
17
30
CRUSHED FEED
32
SOLIDS LADEN BOTTOMS
VAPOR RECOVERY
12
31
15
16
HEAT CARRIERS
14
ROTATING RETORT
13
18
DRY SOLIDS SEPARATION
19

HANDLING OF SOLIDS-LADEN HYDROCARBONACEOUS BOTTOMS IN A RETORT USING SOLID HEAT-CARRIERS

CROSS REFERENCE TO RELATED APPLICATIONS

This application is a continuation-in-part of Copending Application Ser. No. 963,237, filed Nov. 24, 1978, filed by the same inventor and owned by a common assignee, now abandoned.

BACKGROUND OF THE INVENTION

This invention relates to a method of handling and disposal of solids-laden bottoms produced in the processing of oil derived from retorting solid carbonaceous materials in a retort using heated solids to provide heat for the retort.

Gases and oil vapors are produced by retorting crushed oil shale, coal or tar sands. As used herein, the term retorting refers to the use of hot heat carrying solids to thermally convert the organic substances in these normally solid carbonaceous materials to a vapor product. The term retorting does not include liquefaction processes using heated liquids or slurries, or processes using direct combustion of the feedstock or heated gases to directly retort the feedstock. Retorting, therefore, produces a retort effluent containing oil vapors, gases, and spent solids. In retorting processes using solid heat carriers, the retort hydrocarbonaceous effluent product vapors contain an appreciable amount of particulate matter derived from the action of mixing the carbonaceous feed with the heat carriers. Moreover, the retort vapors contain impurities deleterious to use of the retort oils, for example, refer to U.S. Pat. No. 4,069,140. In a retort facility, the oils from the retort are processed in a number of ways which eventually produce a plus 950° F. (510° C.) bottoms or residual carbonaceous fraction which is laden with particulate matter derived from the carbonaceous feed. For example, the retort oils may be prerefined to fuel oil or a synthetic crude oil, or the retort oils may be treated to make the oil more pumpable in a pipeline, or the retort oils may be subjected to thermal cracking to produce chemical feedstocks.

Typically, the bottoms fraction containing appreciable matrix solids from the carbonaceous feed is subjected to steam stripping and the solids-laden residue delivered to a coking facility (e.g., a delayed or fluid bed coker) to remove as much of the useful product as is practical. The remaining solids are disposed of with other waste solids.

SUMMARY OF THE INVENTION

Crushed solid carbonaceous material from a coal, oil shale or tar sands mine is retorted at temperatures of between 700° F. (371° C.) and 1200° F. (649° C.) in a retort using heated solids to provide at least fifty percent of the heat for the retort to produce a retort effluent mixture of carbonaceous oil vapors (oil gases and mist) and hydrocarbon gases. The effluent may also contain other gases or vapors produced or used in the retort. Retorting produces particulate solid waste comprised of spent matrix or inorganic solids derived from the retorted carbonaceous material. The carbonaceous oil produced by the retort contains particulate matter also derived from retorting the carbonaceous materials with solid heat carriers. The carbonaceous oil from the retort is processed in a way that eventually produces a bottoms or residual oil fraction that is comprised of carbon compounds boiling above 950° F. (510° C.) and particulate inorganic matter derived from the retorted carbonaceous material. This bottoms fraction is passed to the retort to use or recover some or all of the carbon compounds and to dispose of the particulate solids with the spent waste solids produced in the retort. The sensible heat in the heated solids supplies at least fifty percent of the heat required to retort the carbonaceous feedstock. The heated solids are, therefore, at a temperature above the retort temperature. These heat carriers are usually made of substances which will fracture or break or which will agglomerate if they were contacted by the solids-laden bottom fraction. In this invention, the bottoms fraction must, therefore, be added to the retort in a manner such that heat carrier breakage or agglomeration does not occur. This is accomplished by adding the bottoms fraction either to the carbonaceous feedstock before it reaches the retort or to the heat carriers and carbonaceous feedstock particles after they have mixed in the retort.

The bottoms fraction may be produced by first quenching the oil vapors in an oil quench tower to remove the entrained solids. The quench tower produces a solids-laden carbonaceous fraction which is then stripped with steam to recover some of the organic carbon compounds and produce the bottoms fraction which is passed to the retort.

BRIEF DESCRIPTION OF THE DRAWING

The drawing is a partial schematical and diagrammatical flow illustration of a system for carrying out a preferred sequence of the improved method for handling and disposing of solids-laden bottoms in a retorting facility using recycled heat carriers to heat the retort.

DETAILED DESCRIPTION OF THE PREFERRED EMBODIMENTS

As a preliminary stage in the production of hydrocarbon products, the normally solid carbonaceous organic matter in oil shale, coal or tar sands is pyrolyzed or retorted in retort 11 which is operated at a temperature of between 700° F. (371° C.) and 1200° F. (649° C.). The term retorting refers to the use of hot heat carriers to thermally convert the organic carbonaceous substances in oil shale, coal or tar sands to oil vapors and gases thereby leaving solid particulate spent matrix or inorganic material. As used herein, the term retorting does not include liquefaction processes using heated liquids or slurries, or processes using combustion or hot gases to directly retort the carbonaceous matter. Many processes using solid heat carriers have been suggested for retorting, for example, reference may be made to U.S. Pat. Nos. 3,008,894 and 3,844,929. These processes use solid heat carrying solids, such as alumina, metal, sand, ceramic balls, pellets, or particulate solid partially spent matrix material. In these processes, the heat carrying solids are usually expensive and must be separated from the spent shale.

In this retorting process, raw or fresh carbonaceous material which was mined and crushed or ground to a suitable size for handling in a retort system is fed directly from a crusher or from a hopper or accumulator by way of crushed feed inlet line 12 into rotating retort 13. At the same time, hot heat carrying retort solids at an average temperature of between 1000° F. (537° C.)

and 1400° F. (760° C.) are fed by gravity or other mechanical means to the retort by way of hot retort solids inlet pipe 14. The hot heat carrier solids and the carbonaceous feedstock could be fed to the retort by way of a common retort inlet if desired. The carbonaceous feedstock may or may not be preheated by direct or indirect heating means. The feedstock and heat carriers are metered so that the ratio of hot heat carrier solids to feedstock on a weight basis is between 0.5 and 3.5 with a ratio between 1.5 to 2.5 being usually preferred. The ratio is such that the sensible heat in the hot heat carriers is sufficient to provide at least fifty percent of the heat required to heat the carbonaceous feedstock from its feed temperature to the designed retort temperature which will be between 700° F. (371° C.) and 1200° F. (649° C.).

The retort is any sort of retort or drum which causes an intimate mixing of the crushed feedstock and the hot retort solids, for example, a rotating drum. This type of retort is quite flexible over a wide range of conditions and causes rapid solid-to-solid heat exchange between the organic feedstock and the hot heat carrier solids in a way which allows the vapors to separate from the solids without passing up through a long bed of solids and which minimizes dilution of the product vapors. The retorting process is usually carried out in concurrent or parallel flow fashion with the hot retort solids and the organic feedstock being fed into the same end of the retort. The retort may be maintained under any pressure which does not hamper efficient operation of the retort. As the retort is rotated, the hot heat carrier solids and the crushed feedstock are admixed and the feedstock is rapidly heated by sensible heat transfer from the hot retort solids to the feedstock. Any water in the organic feedstock is distilled and the carbonaceous matter is decomposed, distilled, and cracked into gaseous and condensible oil fractions, thereby forming valuable vapor effluents including gases, oil vapors, and superheated steam. Pyrolysis and vaporization of the carbonaceous matter in the feedstock leaves a particulate spent mineral matrix matter which contains relatively small amounts of unvaporized or coked organic carbon-containing material.

As the retort zone is operated, the mixture of solids moves toward retort exit 15. Mixture movement is continuous and is aided by the action or design of this type of retort and by continuously withdrawing solids from the exit end of the retort. The rotating retort drum is especially suited to this purpose and to varying the residence time. The usual residence time is between about 3 to about 20 minutes. The mixture of vapor effluents and solids exits from the retort at retort exit 15 at an elevated temperature which depends on the operating temperature of the retort. The retort usually operates at a temperature of between 700° F. (371° C.) and 1200° F. (649° C.). As shown, the mixture of vapor effluents and solids passes into revolving screen or trommel 16 which has openings or apertures sized to pass the heat carrier solids and the part of the spent matrix material that is equal to or smaller than the heat carriers. The trommel extends into vapor recovery section 17 and acts as a first stage of dry separation of the heat carrier solids. In the trommel, the gaseous and vaporous effluents containing a desired hydrocarbon value separate from the solids and at the same time, at least a portion of the larger spent matrix particles or agglomerates are separated from the remaining solids and pass outward through line 18. The remaining solids pass through the openings in the trommel and drop to the bottom of the vapor recovery section to exit via solids exit line 19 where the solids are processed (not shown) for recovery and reheating of the heat carriers. The part of the retorting system for separating the solids, oil vapors and gases may be any sort of exiting and separating system and may be comprised of any number of units of equipment for separating and recovering one or more of these three classes of retort materials. The heat carriers are expensive and are recovered and reheated for recycle back to the retort. Loss of heat carriers through breakage and agglomeration must be avoided.

The product vapors and gases resulting from retorting the carbonaceous feedstock are collected overhead in the vapor recovery section and rapidly pass to overhead exit line 20. The usual exit temperature for this type of retort is between about 680° F. (360° C.) and 950° F. (510° C.) In the type of retorting system described herein, there is no need to use carrier, fluidizing or retorting gases in the retort. The vaporous effluent is, therefore, able to leave the retort essentially undiluted by extraneous fluids except for water or steam vapor derived from the carbonaceous feedback, or added to prevent or retard carbonization, or added to sweep product vapors from the solids, or added for other reasons. The vaporous effluent contains an appreciable amount of particulate inorganic matter derived from retorting the carbonaceous feedstock material and the mixing of the heat carriers and feedstock. The vapors may be initially subjected to a mechanical form of hot dust or fine solids separation to remove some of the entrained solids.

In a retort facility, the oils produced by the retort are processed in a way that produces a bottoms fraction which is comprised of organic carbon compounds having a boiling point above 950° F. (510° C.) and the particulate inorganic matter derived from the retorted carbonaceous material. For example, the retort oil may be prerefined to fuel oil or a synthetic crude oil, or the retort oil may be subjected to a treatment which makes the oil more pumpable in a pipeline, or the retort oil may be subjected to thermal cracking to produce chemical feedstocks. The preferred method of processing the retort oil to produce the solids-laden bottoms fraction is illustrated in the drawing wherein the vaporous effluent from vapor recovery section 17 is passed by way of line 20 to quench tower 21. Quench oil is sprayed or injected into the tower by way of oil inlet line 22 to rapidly cool the oil vapors and remove the particulate inorganic matter entrained in the oil vapors. The operation of quench towers is well known. This produces a carbonaceous fraction in the bottom of the quench tower. This carbonaceous fraction is comprised of organic carbon compounds and the particulate inorganic matter derived from the retorted carbonaceous cool oil shale or tar sands. The uncondensed valuable portions of the oil vapors and gases exit the quench tower via quench tower overhead line 23. The solids-laden carbonaceous fraction is passed through bottom line 24 to pump 25 through inlet line 26 to steam stripper 27. Steam is sprayed or injected into the stripper via steam line 28 to heat and reduce the vapor pressure of the organic carbon compounds in the carbonaceous fraction fed to the stripper. The operation of steam strippers is well known. The carbon compounds vaporized in the steam stripper are carried out stripper overhead line 29 and the remaining bottoms fraction containing carbon compounds having a boiling point above 950° F. (510° C.)

and the inorganic particulate matter is passed to retort 13.

In this invention, the solids-laden bottoms fraction must be added to the retort in a manner such that bottoms fraction does not contact hot heat carrier solids before they have had a chance to contact the carbonaceous feedstock. Otherwise the solids-laden bottoms fraction is likely to cause agglomeration or breakage of the valuable heat carriers. This may be accomplished by adding the bottoms to the retort at a point after the feedstock and heat carriers have mixed together or by injecting the bottoms fraction into the feedstock before it has entered the retort. Preferably, as shown, the bottoms fraction is passed through bottom line 30 to pump 31 and is sprayed via line 32 into the crushed carbonaceous feed in retort inlet line 12 before the carbonaceous feedstock reaches the retort or is combined with the heat carrying retort solids. This disperses the solids-laden bottoms fraction in the raw carbonaceous feed. In the type of retort system described, when the carbonaceous feed with the bottoms fraction is retorted, some of the carbon compounds in the bottoms fraction will be thermally recovered or cracked and some or all of the particulate inorganic matter in the bottoms fraction will be included in the previously described spent solid waste matter formed in the retort.

The foregoing description of a preferred method of this invention illustrates the novel features and advantages of disposing of a solids-laden bottoms fraction with carbonaceous feed to retort. Reasonable variations and modifications are practical within the scope of this disclosure without departing from the spirit and scope of the appended claims. For example, any appropriate type retort may be used and the bottoms fraction may be formed anywhere in the overall retort facility, e.g., in a demineralizer. By way of further example, the quench tower and steam stripper may be used on any vaporous oil containing the particulate inorganic solids and more than one stage of quenching or stripping may be used.

The embodiments of the invention in which an exclusive property or privilege is claimed are defined as follows:

1. In a retorting facility for a mined solid carbonaceous material to produce a hydrocarbon product, a method for handling a bottoms fraction containing organic carbon compounds and particulate inorganic matter derived from said solid carbonaceous material comprising:

(a) feeding crushed mined carbonaceous material to a retort;

(b) feeding hot heat carrying solids to said retort at a retort inlet temperature of between 1000° F. and 1400° F. and in a quantity such that the ratio of said heat carrying solids to said carbonaceous material on a weight basis is such that the sensible heat in said hot heat carrying solids is sufficient to provide at least fifty percent of the heat required to heat said carbonaceous material from its retort feed temperature to a retort zone outlet temperature of between 700° F. and 1050° F.;

(c) operating said retort at a temperature above 700° F. in a way that said carbonaceous material and said hot heat carrying solids mix, thereby producing a carbonaceous oil, said oil containing particulate matter derived from retorting said carbonaceous material, and thereby producing particulate solid waste matter derived from retorting said carbonaceous material;

(d) processing said oil in a way that produces a bottoms fraction, said bottoms fraction being comprised of organic carbon compounds having a boiling point above 950° F. and particulate inorganic matter derived from said carbonaceous material, and (e) passing said bottoms fraction to a point in said retort after the point where said carbonaceous material and said heat carrying solids have first mixed.

2. The method of claim 1 wherein step (d) is comprised of quenching oil produced in step (c) in a quench tower with a quench oil to remove particulate inorganic matter in said oil vapor thereby producing a first carbonaceous fraction, said first carbonaceous fraction being comprised of organic carbon compounds and particulate inorganic matter derived from the carbonaceous material retorted in step (c), and steam stripping said first carbonaceous fraction to remove a portion of said organic carbon containing compounds in said first fraction thereby producing said bottoms fraction.

3. In a retorting facility for a mined solid carbonaceous material to produce a hydrocarbon produce, a method for handling a bottoms fraction containing organic carbon compounds and particulate inorganic matter derived from said solid carbonaceous material comprising:

(a) feeding crushed mined carbonaceous material to a retort;

(b) feeding hot heat carrying solids to said retort at a retort inlet temperature of between 1000° F. and 1400° F. and in a quantity such that the ratio of said heat carrying solids to said carbonaceous material on a weight basis is such that the sensible heat in said hot heat carrying solids is sufficient to provide at least fifty percent of the heat required to heat said carbonaceous material from its retort feed temperature to a retort zone outlet temperature of between 700° F. and 1050° F.;

(c) operating said retort at a temperature above 700° F. in a way that said carbonaceous material and said hot heat carrying solids mix, thereby producing a carbonaceous oil, said oil containing particulate matter derived from retorting said carbonaceous material, and thereby producing particulate solid waste matter derived from retorting said carbonaceous material;

(d) processing said oil in a way that produces a bottoms fraction, said bottoms fraction being comprised of organic carbon compounds having a boiling point above 950° F. and particulate inorganic matter derived from said carbonaceous material, and (e) passing said bottoms fraction into crushed mined carbonaceous material before said crushed mined carbonaceous material is fed to the retort in step (a).

4. The method of claim 3 wherein step (d) is comprised of quenching oil produced in step (c) in a quench tower with a quench oil to remove particulate inorganic matter in said oil vapor thereby producing a first carbonaceous fraction, said first carbonaceous fraction being comprised of organic carbon compounds and particulate inorganic matter derived from the carbonaceous material retorted in step (c), and steam stripping said first carbonaceous fraction to remove a portion of said organic carbon containing compounds in said first fraction thereby producing said bottoms fraction.

* * * * *